US005173197A

United States Patent [19]

Kleeblatt

[11] Patent Number: 5,173,197

[45] Date of Patent: Dec. 22, 1992

[54] SLIDE PLATE FOR SLIDE GATE VALVES

[75] Inventor: Schmuel Kleeblatt, Mamer, Luxembourg

[73] Assignee: Cerafer S.A.R.L., Mamer, Luxembourg

[21] Appl. No.: 664,059

[22] Filed: Mar. 5, 1991

[51] Int. Cl.[5] ..... B22D 41/34

[52] U.S. Cl. ..... 222/600

[58] Field of Search ..... 222/590, 597, 600, 591; 260/236, 287

[56] References Cited

U.S. PATENT DOCUMENTS

| | | | |
|---|---|---|---|
| 4,182,466 | 1/1980 | Fehling et al. | 222/600 |
| 4,265,379 | 5/1981 | Meier | 222/600 |
| 4,508,324 | 4/1985 | Lührsen et al. | 222/600 |
| 4,573,616 | 3/1986 | Shapland | 222/600 |
| 4,627,147 | 12/1986 | Kägi | 222/600 |
| 4,867,428 | 9/1989 | Fricker | 222/600 |
| 4,875,606 | 10/1989 | Keller | 222/600 |
| 5,011,050 | 4/1991 | Verel | 222/600 |

FOREIGN PATENT DOCUMENTS 3805074 9/1989 Fed. Rep. of Germany .

*Primary Examiner*—Scott Kastler

*Attorney, Agent, or Firm*—Robert J. Koch

[57] ABSTRACT

A slide plate for a metallurgical vessel slide gate valve may include a ceramic plate, held by a binder, preferably cement, in a frame. The plate and frame combination is held by frictional force and without mortar in a plate holder. The frame is provided with an outcrimping having a wedge-like configuration tapering from the upper edge to the lower edge of the frame over at least a portion of its circumference. The plate holder is equipped in its area facing the outcrimping with a non-deforming and abrasion resistant clamping rail extending from the bottom to the upper edge. The mortar bed connecting the plate to the frame is recessed in the area of the outcrimping and the cavity formed between the outcrimping and the mortar bed is filled at least in part with a plastically or elastically deformable insert. The rail-like projection may be a profile rod, such as a round rod, positively held in the plate holder and may exhibit an undercut.

20 Claims, 2 Drawing Sheets

SLIDE PLATE FOR SLIDE GATE VALVES

BACKGROUND OF THE INVENTION

1. Field of the Invention

The invention relates to a slide plate for a metallurgical vessel slide gate valve and more particularly for a valve with a ceramic plate, held by a cement binder or the like, in a frame, and fastened with the frame in a plate holder.

2. Description of the Related Technology

DE-OS 32 23 181 shows a slide plate, in which a ceramic plate is bound, without mortar, by a metal strip. Tension is applied to the plate by clamping wedges. The plate is then mounted in the plate holder by fastening the strip to the holder. The known mounting mechanisms are complex moving elements.

A ceramic slide plate is shown in DE-OS 35 22 134. The frontal sides of the plate exhibit bevelling. The plate is clamped in the plate holder by wedge shaped auxiliary elements, in a manner such that a clamping wedge with a counter bevel is pressured by a tensioning screw against the plate. The fastening of the plate is not mortared in a frame and is extraordinarily cumbersome.

DE-OS 27 27 742, DE 28 21 839, DE 36 35 717 and DE 38 05 074 show various solutions for the installation of ceramic plates mortared into a plate holder. In DE 27 27 742, DE 28 21 839 and DE 36 35 717, expensive moving elements are used to fasten the plate. DE-OS 34 20 810 shows one or several additional bores provided in the plate to facilitate mounting with bolts in the supporting frame. This solution is rather cumbersome and requires high dimensional accuracy of the bolts and bores in order to assure that the bolts fit into the bores, and that no excessive clearance is created, which may lead to shifting the plate.

SUMMARY OF THE INVENTION

It is an object of the present invention to provide a slide plate where the plate is encased in a metal strip or mortared into a frame and may be simply mounted, i.e., without moving the fastening mechanism and without the use of mortar, in the plate holder.

According to the invention a slide plate for metallurgical vessel slide gate valves may include a ceramic plate, held by a binder such as cement, in a frame. The frame and plate are advantageously fastened without mortar, by frictional force, in a plate holder. The frame may be provided with an outcrimping having a wedge-like configuration tapering from the upper edge to the lower edge of the frame over a portion of its circumference. The plate holder may be equipped with a clamping rail in an area facing the outcrimping extending from the bottom to the upper edge. The clamping rail may be made of a nondeforming and abrasion resisting material. The mortar bed connecting the plate to the frame may be recessed in the area of the outcrimping. The cavity between the outcrimping and the mortar bed is advantageously filled at least in part with a plastically or elastically deformable insert. The rail-like projection or clamping rail may be formed by a profile rod, preferably a round rod, positively held in the plate holder. Additionally, the clamping rail may be provided with an undercut.

By using a frame equipped in the manner described over at least part of its circumference with outcrimpings tapering from the upper to the lower edge, it has become possible to mount the plate by frictional force.

The plate can be mounted by simply pressing it into the plate holder. The crimped part of the frame is deformed during the process of insertion and is thereby tightly clamped in the frame. The configuration of the frame according to the invention is of particular advantage in the case of slide plate configurations where the ceramic plate is held in a pot-shaped frame rather than in a strip mount. In these cases, the (wedge shaped) outcrimping extends from the lower bottom edge to the upper edge of the lateral surface. This effect can be further reinforced by the application of an abrasion-resistant nondeforming rail, extending in the area opposite the outcrimping essentially parallel to the wall, from the bottom to the upper edge. The crimped part of the frame is deformed inwardly and bends around the rail while fixedly clamping the entire plate.

In a particularly advantageous embodiment the mortar bed connecting the plate to the frame is recessed in the area of the outcrimping and the cavity formed between the crimping and the mortar or plate bottom is filled at least in part with a plastically or elastically deformable insert. In this case it is possible to slightly undercut the rail without damaging the ceramic body of the plate. The crimped part, by virtue of the slight elasticity of the material behind the rail, or inversely the rail, overlaps the edge of the frame following the insertion of the plate into the plate holder, thereby insuring the absolutely secure seating of the plate in its holder.

The clamping rail may have any configuration desired, i.e., it may be a profiled or a round rod.

Further embodiments and advantages will become apparent from the following description of the preferred embodiment.

DETAILED DESCRIPTION OF THE PREFERRED EMBODIMENT

Figure 1:
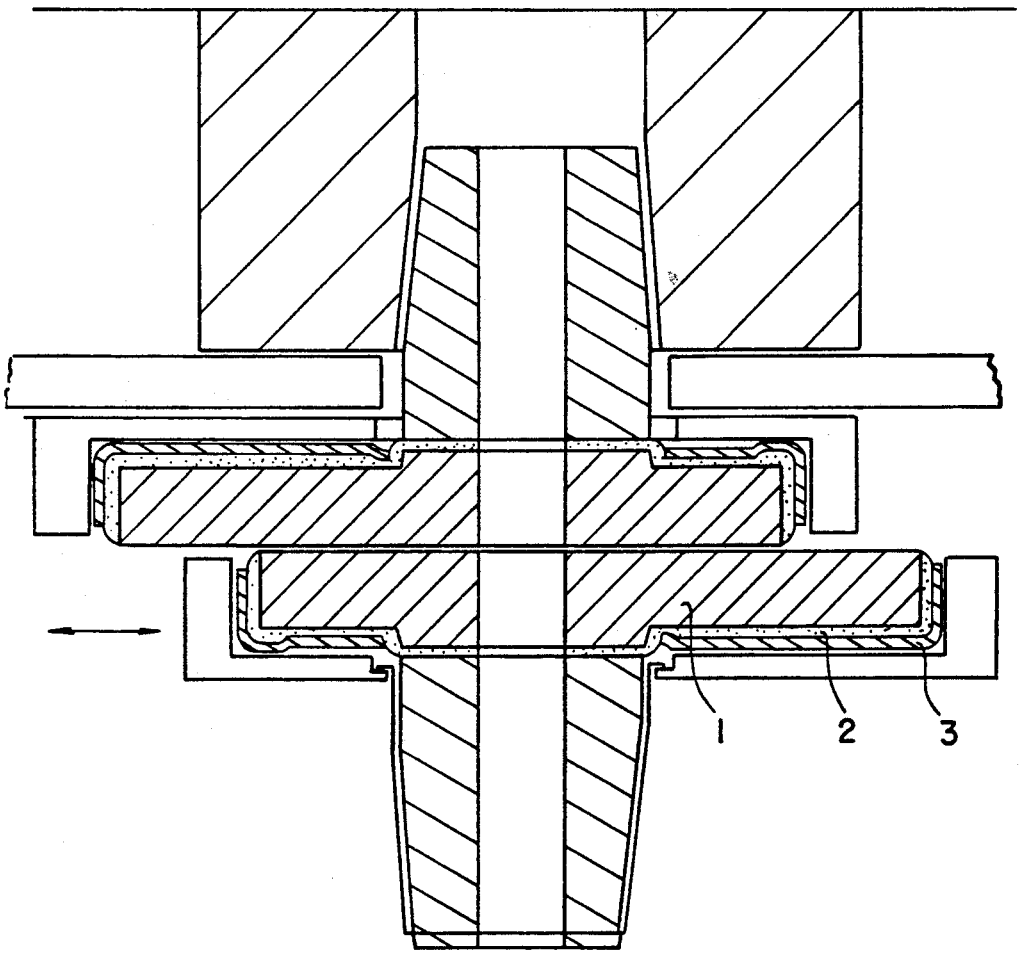
FIG. 1 shows an elevational view in section through a slide gate valve according to the invention.
Figure 2:
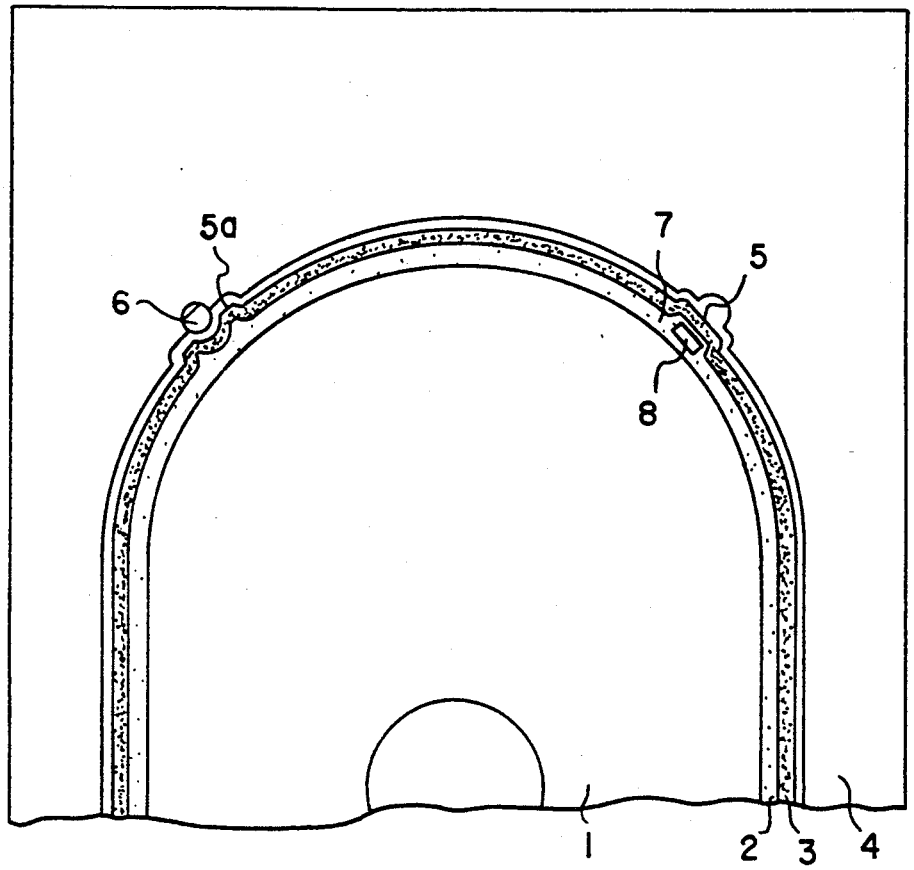
FIG. 2 shows an enlarged top elevation of a part of a plate.

The slide gate valve for a metallurgical vessel shown in the drawing includes a ceramic plate 1. The plate 1 is held in a frame 3 by a binder 2. According to the preferred embodiment, the binder may be cement. The plate 1 and frame 3 are mounted in a plate holder 4 by frictional force and without mortar. As shown in FIG. 2, the frame 3 is provided with an outcrimping 5, 5*a*, in two partial areas of the circumference of the part shown. The outcrimpings 5 or 5*a* are not straight. They taper from the upper to the lower part of the frame 3 in the shape of a wedge. The plate holder 4 is equipped with a nondeforming and abrasion resistant clamping rail in the area opposite the crimping 5, 5*a*. The clamping rails 6 extend from the bottom to the upper edge, essentially parallel to the wall. For the sake of clarity, only one rail is indicated in the drawing.

In the embodiment shown in the drawing, the plate 1 or respectively the mortar bed holding it in the frame is recessed in the area of the outcrimping 5 and the cavity 7 formed between outcrimping 5 and mortar bed 2 is filled by an insert 8 of a plastically or elastically deformable and compressible material.

Figure 3:
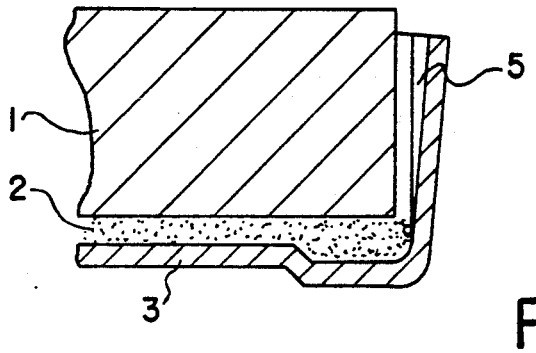
FIG. 3 shows an enlarged view through a partial section of the plate in the area of the outcrimping.

Prior to the insertion of the plate into the holder, the outcrimpings have the shape shown in the top right portion of FIG. 2, or in FIG. 3. During the insertion of the plate into the plate holder, the compressible insert 8 is displaced and the crimpings are deformed, initially elastically and then plastically, into the form 5*a* shown in the top left portion of FIG. 2. By virtue of its elasticity and deformation, the outcrimping 5 tightly abuts the clamping rail 6. According to one embodiment, the clamping rail 6 may have a slightly elastic shape, so that after the plate is mounted it overlaps the upper edge of the frame. The secure seating of the plate in its frame is thereby assured. The description set forth above clearly indicates that the assembly may be carried out without any auxiliary elements by simple insertion of the plate and frame under pressure into the plate holder. According to the embodiment described, all unavoidable tolerances are readily equalized.

The illustrated embodiment is shown by way of example. The spirit and scope of the invention is not to be restricted by the preferred embodiment.

I claim:

1. A metallurgical vessel slide gate valve slide plate comprising:

a frame exhibiting one or more circumferential outcrimpings with tapered configurations, said outcrimpings taper from an upper edge of said frame to a lower edge of said frame;

a ceramic plate located within said frame; and binder material securing said ceramic plate to said frame.

2. A slide plate according to claim 1, wherein said outcrimpings exhibit a wedge configuration tapered from an upper edge of said frame to a lower edge of said frame.

3. A slide plate according to claim 2, wherein said binder material is cement.

4. A slide plate according to claim 1, further comprising a deformable insert located between said outcrimping and said ceramic plate.

5. A slide plate according to claim 4, wherein said insert is elastically deformable.

6. A slide plate according to claim 1, further comprising a plate holder, and wherein said frame is frictionally received in said plate holder.

7. A slide plate according to claim 6, wherein said plate holder exhibits one or more clamping rails and corresponding to and associated with said outcrimpings.

8. A slide plate according to claim 7, wherein said clamping rails are nondeforming and abrasion resistant.

9. A slide plate according to claim 8, wherein said clamping rails extend at least to an upper edge of said frame.

10. A slide plate according to claim 7, wherein said clamping rails are configured as cylindrical clamping rods.

11. A slide plate according to claim 7, wherein said clamping rails exhibit an undercut configured to engage an upper edge of said frame.

12. A slide plate according to claim 11, wherein said clamping rails are elastically deformed, when said frame engages said clamping rails.

13. A slide plate according to claim 7, wherein said clamping rails are elastically deformed, when said frame engages said clamping rails.

14. A slide plate according to claim 5, further comprising a plate holder, and wherein said frame is frictionally received in said plate holder.

15. A slide plate according to claim 14, wherein said plate holder exhibits one or more clamping rails and corresponding to and associated with said outcrimpings.

16. A slide plate according to claim 15, wherein said clamping rails are nondeforming and abrasion resistant.

17. A slide plate according to claim 16, wherein said clamping rails exhibit an undercut configured to engage an upper edge of said frame.

18. A slide plate according to claim 17, wherein said clamping rails are elastically deformed, when said frame engages said clamping rails.

19. A metallurgical vessel slide gate valve slide plate comprising:

a self-locking frame exhibiting at least one elastically deformable segment; and a ceramic plate located within and secured to said self-locking frame;

wherein said self-locking frame is configured to elastically deform upon insertion in a plate holder, thereby forming a self-locking connection between the plate holder and said self-locking frame and said ceramic plate.

20. A slide plate according to claim 19, wherein said elastically deformable segment exhibits at least one circumferential outcrimping having a tapered configuration.

* * * * *